United States Patent [19]

Hagewood et al.

[11] Patent Number: 4,852,225

[45] Date of Patent: Aug. 1, 1989

[54] DRAW WARPING APPARATUS

[75] Inventors: John F. Hagewood, Monroe; Kurt W. Niederer, Charlotte; Daniel W. McCoy, Sr., Monroe, all of N.C.

[73] Assignee: McCoy-Ellison, Inc., Monroe, N.C.

[21] Appl. No.: 212,214

[22] Filed: Jun. 27, 1988

[51] Int. Cl.[4] ..... D02H 13/08; D02J 1/22

[52] U.S. Cl. ..... 28/187; 28/172; 28/242

[58] Field of Search ..... 28/172, 185, 186, 187, 28/241, 242; 264/40.1

[56] References Cited

U.S. PATENT DOCUMENTS

| | | | |
|---|---|---|---|
| 4,592,119 | 6/1986 | Bauer et al. | 28/172 X |
| 4,611,410 | 9/1986 | Brossmer | 28/172 X |
| 4,630,340 | 12/1986 | Bauer et al. | 28/172 X |
| 4,644,622 | 2/1987 | Bauer et al. | 28/172 X |
| 4,669,159 | 6/1987 | Bogucki-Land | 28/172 X |
| 4,715,097 | 12/1987 | Bogucki-Land | 28/172 |

FOREIGN PATENT DOCUMENTS

| | | | |
|---|---|---|---|
| 0047348 | 3/1982 | European Pat. Off. | 28/242 |

OTHER PUBLICATIONS

"Draw-Warping-Mayer Warp Drawing Machine Developed Further"; *Man-Made Fiber Year Book* (CTI) 1986, pp. 104-105.

"Warp Preparation-Production of Warps from Flat Synthetic Filament Yarns", *Textile Month*, May 1984, pp. 48-50.

"Draw-Warping-Effect of Machine Downtimes in Draw-Warping on Yarn Properties"; *Man-Made Fiber Year Book* (*CTI*) 1987, pp. 118-119.

"Draw-Warping - Draw-Warping and Draw-Warp--Sizing System for POY and Undrawn Yarns"; *Man--Made Fiber Year Book* (*CTI*) 1986, pp. 108-110.

"Draw-Warping - Draw-Warping: the State of the Art"; *Man-Made Fiber Yearbood* (*CTI*) 1986, pp. 106-107.

"New Systems for Draw-Beaming POY Yarns"; *Fiber World*, Sep. 1984, pp. 61-68.

*Primary Examiner*—Robert R. Mackey

*Attorney, Agent, or Firm*—Shefte, Pinckney & Sawyer

[57] ABSTRACT

A drawing apparatus for a textile draw warping system includes rotatable feed, swing, godet and take-up rolls about which a plurality of synthetic continuous filaments travel in sequential peripheral engagement. The godet and take-up rolls are driven at different relative speeds with the godet roll being heated above the glass transition temperature of the filaments to cause drawing of the filaments between the godet and take-up rolls. A heated contacts the filaments between the godet and take-up rolls to crystalize the drawn filaments. The godet and swing rolls are mounted for movement in respective arcuate paths which are mutually convex to one another for disengaging the filaments from the godet roll upon stoppage of the drawing system while maintaining constant filament tension to prevent overheating and degradation of the filaments. The platen is also movable away from the filament path upon system stoppages in coordinated relation to the decreasing speed of filament travel.

11 Claims, 6 Drawing Sheets

DRAW WARPING APPARATUS

BACKGROUND OF THE INVENTION

The present invention relates to the drawing and heat setting of extruded synthetic continuous textile filaments and, more particularly, to textile draw-warping systems wherein filament drawing and heat setting is combined in the same operation with the preparation of a textile warp beam.

Since the development of extruding systems for producing continuous filaments of synthetic polymeric materials suitable for use as textile yarns, it has been recognized that the physical properties of a continuous filament may be selectively controlled by subjecting the filament to a stretching process while applying heat above the glass transition temperature of the filament to effect alignment and ordering of the molecular and crystalline structure of the filament to a desired degree, commonly referred to as drawing. Conventionally, drawing has been carried out in the past as a separate process following spinning of the filament. However, it has been discovered that the molecular structure of filaments becomes increasingly oriented with the elevation of spinning speeds enabling achievement of a sufficient drawing effect in certain cases to enable the elimination of a separate drawing step, various applications of this technique being referred to as draw-spinning or spindrawing. Nevertheless, this technique suffers the disadvantages of being relatively expensive and, in some cases, producing less than optimal draw results. Since a significant proportion of drawn filamentary yarns are utilized in the textile industry in warp knitting and weaving processes, considerable attention has been devoted more recently to combining the drawing process with the winding of filamentary yarns onto a warp beam preparatory to knitting or weaving, which has come to be known as draw-warping. The draw-warping technique has thus far proved to provide two significant advantages. First, unusually high quality fabric may be produced using this combined drawing and warp preparation process in that all of the filaments formed into a fabric are drawn under essentially identical mechanical and thermal conditions. Further, draw-warping enables improved efficiency with lower capital investment costs enabling higher profit margins to be achieved.

Perhaps the most widely utilized and known machinery for draw-warping is the Model DSST equipment manufactured by Karl Mayer of Obertshausen, West Germany. Basically, draw-warping is carried out with this equipment by feeding a sheet of parallel warp yarns through a drawing unit consisting of a sequence of rollers in advance of a warp beaming machine whereat the warp sheet is wound onto a warp beam. The rollers in the drawing unit essentially consist of a group of several parallel side-by-side feed rollers and a group of several parallel side-by-side delivery rollers spaced along the path of travel of the warp sheet. Intermediate the feed and delivery rollers, the warp sheet travels about a deflection pin along an essentially V-shaped path. Inclined heating plates are respectively disposed alongside the two sections of the V-shaped path between the feed rollers and the deflection pin and between the deflection pin and the delivery rollers. The relative speeds of the feed and delivery rollers are controlled to achieve a desired degree of drawing therebetween, with the first heater plate being adapted to elevate the temperature of the filaments in the warp sheet to a desirable drawing temperature while the subsequent heater plate functions to heat set the filaments.

As will be understood, one problem unique to draw-warping is the accommodation of the periodic necessity of interrupting the normally continuous draw-warping operation, for example, when any one of the filaments in the warp sheet breaks or for other reasons experiences a significant loss in tension activating a stop motion arrangement of the draw-warping equipment. With the traveling movement of the warp sheet stopped under such circumstances, the application of heat thereto must be altered in order to prevent excessive localized heating of the warp sheet which can produce filament damage and even breakage and may result in unevenness in the dye uptake of the subsequently produced fabric causing so-called stop marks across the dyed fabric. To avoid this problem when the draw-warping process is interrupted, it is necessary to decrease the heating of the warp sheet to a temperature below the glass transition temperature of the filaments while at the same time maintaining constant filament tension in the draw region so as not to change the draw point along each filament, i.e. the point at which the filament is first subjected to a lengthwise stretching force.

In the Mayer DSST draw-warping machine, the foregoing considerations are addressed during stoppages and restarts of the draw-warping process by arranging the heater plates for movement during machine stoppages away from the warp sheet at a rate proportional to the decreasing travel speed of the warp sheet while simultaneously turning the deflection pin 180 degrees to expose its cooler side to the warp sheet, with the heater plates and the deflection pin being correspondingly returned to their respective former positions upon machine restart.

SUMMARY OF THE INVENTION

It is an object of the present invention to provide a improved drawing apparatus for use in a textile draw warping system utilizing one or more heated godet rolls in order to achieve superior control of the drawing process. It is a further object to provide a suitable means for removing the warp filaments from and reapplying them to the heated godet roll upon stoppages and restarts of the draw-warping system.

Briefly summarized, the drawing apparatus of the present invention utilizes one or more rotatable feed rolls, at least one heated rotatable godet roll and one or more rotatable take-up rolls respectively arranged for training of the filaments of the warp sheet to travel in peripheral engagement sequentially therewith. A suitable drive arrangement is provided for driving the godet and take-up roll at respective relative speeds to achieve a desired degree of drawing of the filaments during their travel between the godet and take-up rolls. Another arrangement is provided to be operative upon stoppage of the drawing apparatus for removing the filaments from engagement with the godet roll to prevent continued application of heat to the filaments while simultaneously engaging the filaments intermediate the feed roll and the godet roll to maintain substantially constant tension along their respective extents between the location of their last contact with the godet roll and the take-up roll and also to maintain a substantially constant length of the filaments between the feed and take-up rolls. This arrangement is further operative upon restart of the drawing apparatus for reengaging the filaments with the godet roll at the same location as the previous contact between the filaments and the godet roll. In this manner, degradation of the filaments during stopping and restarting of the drawings apparatus is prevented.

According to the preferred embodiment of the present invention, a second rotatable godet roll is arranged immediately upstream of the first-mentioned heated godet roll in relation to the path of filament travel. Additionally, a rotatable swing roll is provided for engaging the filaments intermediate the feed roll and the second godet roll. According to the present invention, the second godet roll and the swing roll are displaceable with respect to the filaments to effect filament removal from the godet roll during stoppages of the drawing apparatus and filament reengagement with the godet rolls upon restarts of the drawing apparatus. Preferably, the second godet roll and the swing roll are arranged for displacement along respective arcuate paths which are mutually convex with respect to one another with the displacement path of the second godet roll extending from one circumferential side of the first godet roll to the opposite circumferential side thereof. It is further preferred that the swing roll and the godet rolls be driven by a common drive adapted to permit rotation of the swing and godet rolls during displacement of the swing and second godet rolls.

Further, a heated platen is disposed alongside the path of filament travel between the heated godet roll and the take-up roll for heat setting purposes, the platen being movable away from the filaments upon stopping of the drawing apparatus in advance of displacement of the godet and swing rolls and being movable toward the filaments upon restart of the drawing apparatus after displacement of the swing and godet rolls.

The drawing apparatus includes a frame which supports each of the rolls with its opposite ends extending in cantilevered relation respectively from opposite sides of the frame to facilitate operator access thereto for filament thread-up and like operation.

DESCRIPTION OF THE PREFERRED EMBODIMENT

Figure 1:
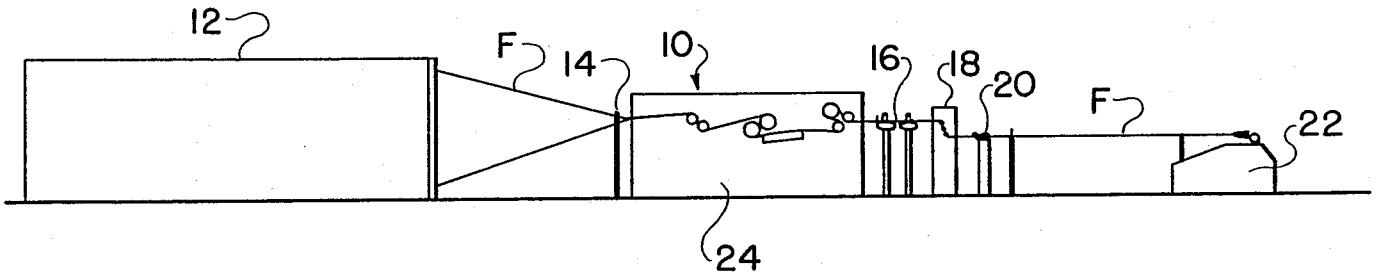
FIG. 1 is a schematic side elevational view of a drawwarping system incorporating the preferred embodiment of the drawing apparatus of the present invention.

Referring now to the accompanying drawings and initially to FIG. 1, a drawing apparatus according to the preferred embodiment of the present invention is shown generally at 10 as preferably embodied in a draw-warping system wherein a creel, representatively indicated at 12, supports a plurality of individual packages of partially oriented synthetic continuous filaments, such as polyester or nylon, which are fed as represented at F generally in side-by-side relation through an eyeboard 14 to the drawing apparatus 10 and travel therefrom through a filament inspecting device 16, a dancer assembly 18 and an oiling device 20, to a warp beaming machine 22, commonly referred to as a warper. For purposes of illustration, the particular embodiment of the present drawing apparatus herein disclosed is adapted for the draw warping of polyester filaments, but those persons skilled in the art will readily recognize that the present drawing apparatus is equally well adapted for the draw warping of nylon and other synthetic filaments.

Figure 2:
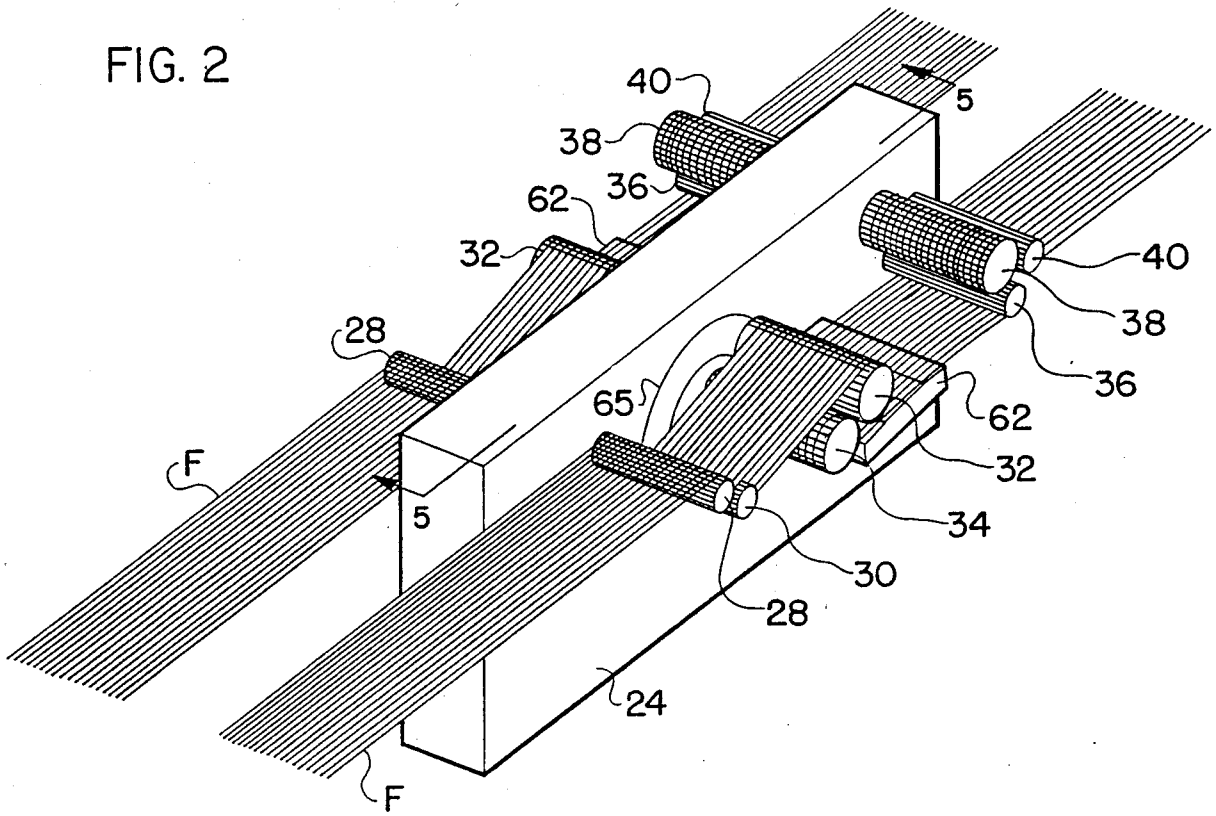
FIG. 2 is a perspective view of the drawing apparatus in the drawwarping system of FIG. 1, in its normal operating mode.
Figure 4:
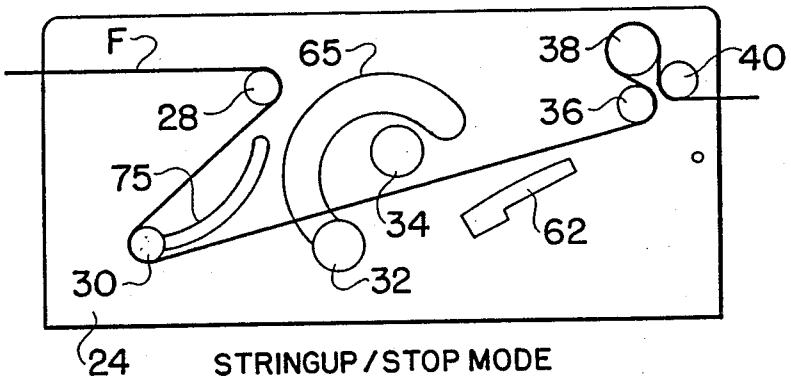
FIG. 4 is another side elevational view similar to FIG. 3, showing the drawing apparatus in its non-operating mode.
Figure 3:
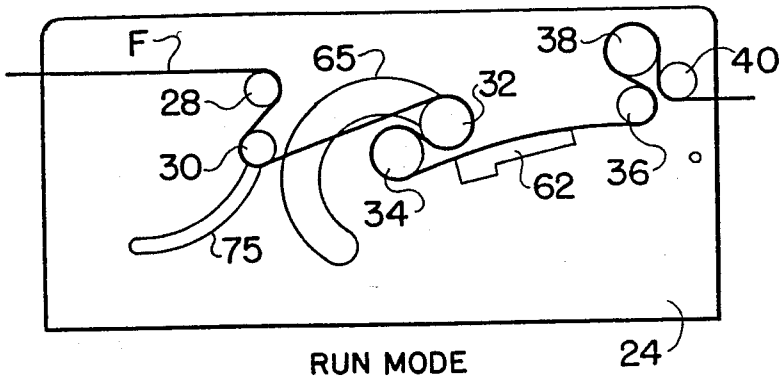
FIG. 3 is a side elevational view of the drawing apparatus in the drawwarping system of FIG. 1, also showing the drawing apparatus in its normal operating mode.
Figure 5:
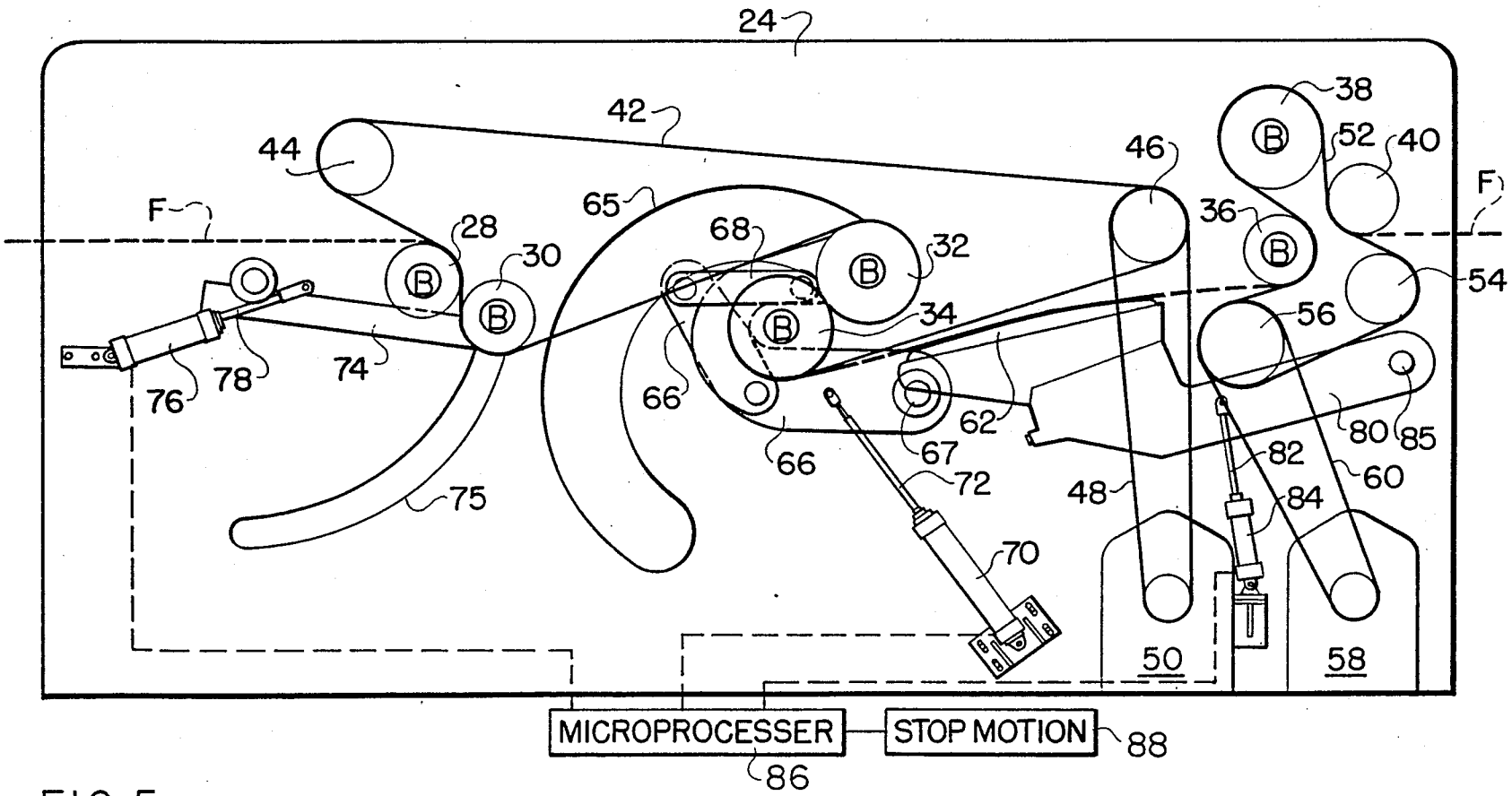
FIG. 5 is a vertical cross-sectional view through the drawing apparatus in its operating mode of FIG. 3.
Figure 6:
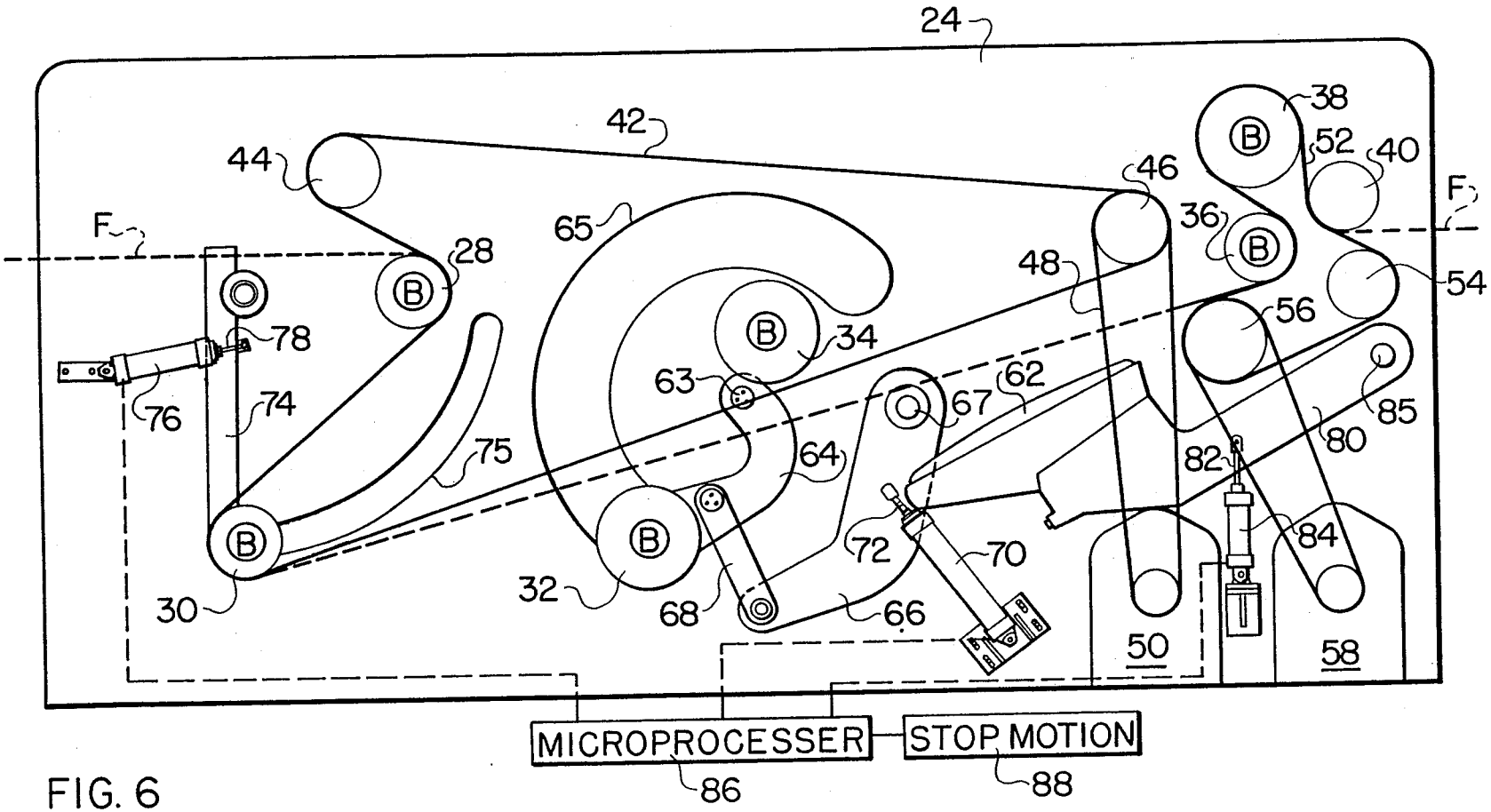
FIG. 6 is another vertical cross-sectional view similar to FIG. 5 showing the drawing the drawing apparatus in its non-operating mode of FIG. 4.

As best seen in FIGS. 2 3, and 4, the drawing apparatus 10 has an upstanding central frame 24 by which a series of draw rollers, including a feed roller 28, a swing roller 30, a pair of godet rollers 32,34 and three take-up rollers 36,38,40, are rotatably supported to extend outwardly in cantilevered fashion from each opposite side of the frame 24 for training of the partially oriented filaments in sequence peripherally about the rollers, as shown. This construction facilitates operator access to the filaments F for ease of the filament thread-up and like operations. Within the interior of the frame 24, the feed rollers 28, the swing roller 30 and the godet rollers 32,34 are synchronously driven in common by an endless drive belt 42 trained in series about the interiorly mounted portions of such rollers as well as about an idler pulley 44 and a drive pulley 46 which, in turn, is driven through another drive belt 48 from a drive motor 50, as shown in FIGS. 5 and 6. Similarly, the take-up rollers 36,38,40 are synchronously driven in common by a drive belt 52 trained peripherally about each thereof and about an idler pulley 54 and a drive pulley 56 which, in turn, is driven by a drive motor 58 through another drive belt 60.

The godet roller 34 has a hollow cylindrical outer shell which is heated by a conventional electromagnetic induction heating system utilizing an electrical coil (not shown) mounted within the godet roller 34 to produce a magnetic flux field causing the outer shell to become sufficiently heated as it rotates through the flux field for heating the filaments F slightly above their glass transition temperature as they travel through the drawing apparatus 10. As necessary or desirable, the godet roller 32 may similarly be provided with a like heating means. A heated platen 62 is positioned for contact with the filaments F along the extent of their travel from the godet roller 34 to the first take-up roller 36 for heating the filaments F to a more elevated temperature sufficient to achieve crystalization of the filaments. The respective drive systems for the feed, swing and godet rollers 28,30,32,34 and for the take-up rollers 36,38,40 are adjustable to enable selective control of the relative speeds of each set of rollers to achieve a predetermined speed differential therebetween. In this manner, the heated filaments are caused to be drawn longitudinally to a predetermined desired degree from the point at which the filaments leave contact with the godet roller 34 to the first take-up roller 36, the platen 62 being operative in this area to crystalize, or heat set, the filaments.

To accommodate the occasional necessity of stopping the drawing apparatus during its above-described normal operation, the swing roller 30 and the godet roller 32 are individually mounted for arcuate movement and the heated platen 62 is similarly mounted for arcuate movement to remove the filaments from contact with the godet rollers 32,34 and the platen 62 in the event of a stoppage of the draw warping system. For this purpose, the godet roller 32 is rotatably supported at the free end of a generally L-shaped crank arm 64 pivotably supported at its opposite end within the frame 24 at a pivot location 63 substantially opposite the godet roller 34 from the normal operating position of the godet roller 32. Pivotal movement of the crank arm 64 is actuated by a drive arm 66 pivoted within the frame 24 at one end thereof at a pivot location 67 and connected at the opposite end thereof with the crank arm 64 through a drive link 68, the opposite ends of which are pivoted respectively to the crank arm 64 and the drive arm 66. Pivotal actuating movement of the drive arm 66 is controlled through a hydraulic piston and cylinder assembly 70 mounted within the frame 24 with the extensible piston 72 thereof pivotably connected to the drive arm 66 centrally along its length. Through this mechanism, the godet roller 32 is thereby movable through an approximately 180 degree arcuate path from its operating position shown in FIGS. 2, 3 and 5 to a non-operative position shown in FIGS. 4 and 6 at the opposite circumferential side of the godet roller 34, as defined by a slot 65 formed in each upright side wall of the frame 24.

The swing roller 30 is rotatably supported at one end of a pivot arm 74, the opposite end of which is pivotably mounted within the frame 24. Pivotal movement of the pivot arm 74 is controlled by another hydraulically-operated piston and cylinder assembly 76, the piston 78 of which is pivotably attached to the pivot arm 74 adjacent its pivot location. Thus, through this mechanism, the swing roller 30 may be moved through an approximately 90 degree range of arcuate movement extending oppositely to that of the godet roller 32 from the normal operating position of the swing roller 30 adjacent the feed roller 28 as seen in FIGS. 2, 3 and 5 to an inoperative position spaced therefrom as seen in FIGS. 4 and 6, as defined by a slot 75 in each upright side wall of the frame 24.

For the same purpose, the heated platen 62 is similarly mounted to the free end of a pivot arm 80 pivotably supported within the frame 24 at 85 and attached to the piston 82 of another piston and cylinder assembly 84 also supported within the frame 24. In this manner, the platen 62 is pivotable toward and away from the path of filament travel through the drawing apparatus 10 between an operative position shown in FIGS. 2, 3 and 5 wherein the platen 62 is in surface contact with the extent of filament travel between the godet roller 34 and the takeup roller 36 and an inoperative position shown in FIGS. 4 and 6 wherein the platen 62 is pivoted away from such path of filament travel.

The hydraulic piston and cylinder assembly 76 for the swing roller 30 is continuously actuated for withdrawal of its piston 78 to apply a predetermined biasing force urging the roller 30 into tensioning engagement with the drive belt 42 to maintain a predetermined tension in the drive belt 42. Operation of the hydraulic piston and cylinder assemblies 70 and 84 for actuating movement of the godet roller 32 and the platen 62 is controlled by a microprocessor or other suitable controller, representatively indicated at 86, to which each stop motion and the start/stop controls of the draw warping system are operatively input, as collectively indicated representatively at 88.

In normal operation, each piston and cylinder assembly 70,84 is activated to extend its respective piston 72,82 to position the godet roller 32 and the platen 62 in their respective operative dispositions of FIGS. 2, 3 and 5. As a result, the swing roller 30 assumes its operative disposition wherein the piston 78 of the associated piston and cylinder assembly 76 is also substantially extended, to maintain desired tension in the drive belt 42. Thus, as the filaments F travel through the drawing apparatus 10 along the path of travel shown in FIGS. 2, 3 and 5, the filaments F are heated by contact with the periphery of the godet roller 34 (and also the godet roller 32, if heated) to an elevated temperature slightly above the glass transition temperature of the particular filaments F to cause the filaments to be drawn, i.e. stretched lengthwise, at the point of leaving contact with the godet roller 34, as a result of the differential speeds between the godet roller 34 and the first takeup roller 36. The filaments F then travel in contact across the heated facing surface of the platen 62 at a more elevated temperature which serves to heat set, i.e. crystalize, the filaments F in their thusly drawn state.

In the event of any stoppage of filament travel through the drawing system, such as for example when a stop motion device 88 on the creel or elsewhere in the system is activated by a filament breakage or other substantial loss of filament tension, the microprocessor 86 recognizes the system stoppage and automatically deactuates the electric drive motors 50,58 and actuates suitable braking devices, shown only representatively at B, to control the slowing and stoppage of the draw rollers 28,30,32,34,36,38,40. Simultaneously, the microprocessor 86 actuates retraction of the piston 82 of the piston and cylinder assembly 84 to pivot the heated platen 62 away from the filaments F into the non-operative disposition of the platen 62 shown in FIGS. 4 and 6, the pivotal movement being precisely controlled in synchronism with the braking of the rollers and the corresponding slowing of the speed of filament travel to reduce the heat application to the filaments F in direct proportion to the slowing filament speed, thereby insuring a constant heat application to the filaments F. Immediately upon stoppage of the rollers and filament travel, the microprocessor 86 then actuates retraction of the piston 72 of the piston and cylinder assembly 70 to cause the godet roller 323 to move through its respective arcuate path into its nonoperating disposition of FIGS. 4 and 6. The hydraulic biasing force applied to the piston and cylinder assembly 76 causes its piston 78 to withdraw simultaneously for synchronous movement of the swing roller 30 through its respective arcuate path into its respective non-operating disposition of FIGS. 4 and 6, to thereby continuously maintain constant tension in the drive belt 42.

As a result of such movements of the heated platen 62 and the swing and godet rollers 30,32, the filaments F are removed entirely from contact with both godet rollers 32,34 and the platen 62, the filaments F extending in a substantially linear path from their point of leaving contact with the swing roller 30 in its nonoperating disposition to the first take-up roller 36. During the arcuate movements of the swing and godet rollers 30,32, the braking devices B associated with the feed and godet rollers 28,34 remain activated to hold the drive belt 48, the drive pulley 46 and the drive belt 42 fixed against further movement, while the braking device B associated with the swing and godet rollers 30,32 are released to permit such rollers to rotate essentially as idler rollers. Thus, since the path of filament travel and the path of travel of the drive belt 42 are identical between the swing and godet rollers 30,32, as will be seen in FIGS. 3–6, the swing and godet rollers 30,32 are constrained to rotate during their respective arcuate movements to substantially precisely the degree of rotation necessary to avoid the application of a pulling force on the filaments F.

As aforementioned, the arcuate movement of the swing roller 30 is synchronized with the arcuate movement of the godet roller 32 by the hydraulic biasing force applied to the swing roller 30 by its associated piston and cylinder assembly 76 to insure that the swing roller 30 serves to immediately take up the loss of filament tension which otherwise would result from the arcuate movement of the godet roller 32 out of contact with the filaments F and thereby serves to maintain substantially constant both the overall length of each filament F between the feed roller 28 and the first take-up roller 36 and the tension in each filament F along such extent of its length. By thus maintaining substantially constant tension in the filaments F along their respective lengths between the location of their last contact with the godet roller 34 and the first take-up roller 36, the so-called draw point of each filament F, i.e. the point at which each filament F was last in contact with the godet roller 34 whereat each filament F was last subjected to a drawing force, is likewise maintained.

For restart of the draw warping system, the microprocessor 86 first actuates the piston and cylinder assembly 70 to return the godet roller 32 to its respective operative disposition with the swing roller 30 returning synchronously to its operative disposition against the biasing force of the associated piston and cylinder assembly 76 to reengage the filaments F at the identical points of previous contact with the filaments F while continuing to maintain constant filament tension throughout such return movement. Then, the draw warping system is restarted to resume filament travel, the piston and cylinder assembly 84 being activated simultaneously with the drive motors 50,58 with the microprocessor controlling the return pivotal movement of the platen 62 toward its operating disposition in direct proportion to the increasing speed of filament travel to insure uniform heat application. As a result, degradation of the filaments from overheating, overtensioning or the like is prevented during stopping and restarting of the drawing apparatus 10.

Figure 7:
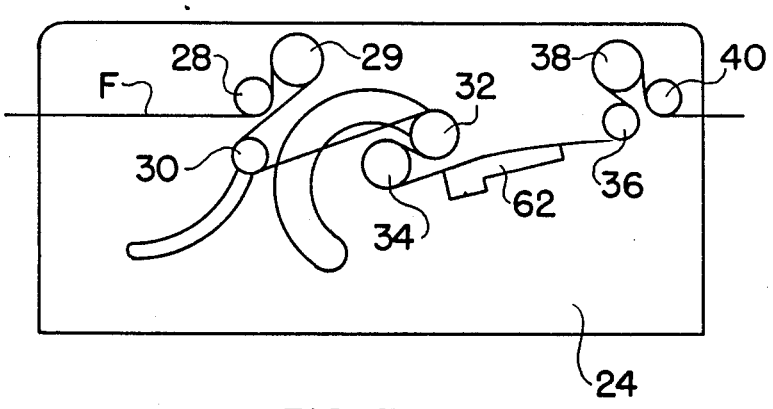
FIG. 7 is a side elevational view similar to FIG. 3 showing an alternate embodiment of the drawing apparatus of the present invention, in its normal operating mode.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. For example, an additional heated feed roller 29 may be provided and separately driven intermediate the feed roller 28 and the swing roller 30 to establish an additional draw zone for adapting the drawing apparatus for the draw warping of nylon filaments 3 as shown in FIG. 7. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile draw warping system wherein a plurality of synthetic continuous filaments which are less than fully oriented are delivered in parallel relationship for winding on a warp beam, a drawing apparatus comprising a rotatable feed roll, a rotatable godet roll and a rotatable take-up roll arranged for training of the filaments to travel in peripheral engagement sequentially therewith, means for heating said godet roll, means for driving said godet roll and said take-up roll at respective relative speeds for drawing said filaments during travel between said godet roll and said take-up roll, stop motion means for actuating stoppage of said drawing apparatus, and means associated with said stop motion means to be operative upon stoppage of said drawing apparatus for removing said filaments from engagement with said godet roll to prevent continued application of heat to said filaments and further operative upon restart of said drawing apparatus for reengaging the filaments with said godet roll at the same location as the previous contact between the filaments and said godet roll, said filament removing and reengaging means including means for maintaining a predetermined tension in the removed filaments along their respective extents between the location of their last contact with said godet roll and said take-up roll and to maintain substantially constant length of the filaments between said feed roll and said take-up roll, thereby to prevent degradation of the filaments during stopping and starting of said drawing apparatus.

2. A drawing apparatus in a textile draw warping system according to claim 1 and characterized further in that said filament removing and reengaging means includes a second rotatable godet roll arranged immediately upstream of the first-mentioned heated godet roll in relation to the path of filament travel.

3. A drawing apparatus in a textile draw warping system according to claim 2 and characterized further in that said filament removing and reengaging means includes means for displacing said second godet roll toward and away from said filaments.

4. A drawing apparatus in a textile draw warping system according to claim 3 and characterized further in that said filament removing and reengaging means includes a rotatable swing roll for engaging said filaments intermediate said feed roll and said second godet roll and means for displacing said swing roll with respect to said filaments in synchronism with said means for displacing said second godet roll.

5. A drawing apparatus in a textile draw warping system according to claim 4 and characterized further in that said driving means includes a common drive means for said swing roll and said first and second godet rolls and means for permitting rotation of said swing and godet rolls during displacement of said swing roll and said second godet roll.

6. A drawing apparatus in a textile draw warping system according to claim 4 and characterized further in that said displacing means for said second godet roll and said displacingmeans for said swing roll define respective arcuate paths for displacement of said second godet roll and said swing roll which are mutually convex with respect to one another.

7. A drawing apparatus in a textile draw warping system according to claim 6 and characterized further in that said displacement path for said second godet roll extends from one circumferential side of said godet roll to the opposite circumferential side thereof.

8. A drawing apparatus in a textile draw warping system according to claim 1 and characterized further by a frame supporting each said roll in cantilevered relation thereto to facilitate operator access thereto for filament thread-up and like operations.

9. A drawing apparatus in a textile draw warping system according to claim 8 and characterized further in that opposite ends of each said roll extend in cantilevered relation respectively from opposite sides of said frame.

10. A drawing apparatus in a textile draw warping system according to claim 1 and characterized further by a heated platen disposed alongside the path of filament travel between said godet roll and said take-up roll and means for moving said platen away from said filaments upon stopping of said drawing apparatus in relation to stoppage of filament travel and toward said filaments upon restart of said drawing apparatus in relation to acceleration of filament travel.

11. A drawing apparatus in a textile draw warping system according to claim 10 and characterized further in that said platen moving means is operative upon stopping of said drawing apparatus in advance of actuation of said filament removing and reengaging means to remove filaments from said godet roll and is operative upon restart of said drawing apparatus after said filament removing and reengaging means is actuated to reengage filaments with said godet roll.

* * * * *